United States Patent [19]

Weller

[11] Patent Number: 4,720,990

[45] Date of Patent: Jan. 26, 1988

[54] EJECTOR MECHANISM FOR ECCENTRIC PRESSES

[75] Inventor: Alois Weller, Erkrath, Fed. Rep. of Germany

[73] Assignees: Th. Kieserling, Postfach; Albrecht GmbH & Co., Solingen, both of Fed. Rep. of Germany

[21] Appl. No.: 870,126

[22] Filed: Jun. 3, 1986

[30] Foreign Application Priority Data

Nov. 10, 1984 [DE] Fed. Rep. of Germany ..... 3437282

[51] Int. Cl.[4] ..... B21J 13/14

[52] U.S. Cl. ..... 72/427; 72/345

[58] Field of Search ..... 10/11 E; 72/345, 346, 72/427

[56] References Cited

U.S. PATENT DOCUMENTS 3,299,453 1/1967 Van De Meerendonk ..... 10/15
4,296,625 10/1981 Weller et al. ..... 72/345
4,552,525 11/1985 Stehr ..... 72/427

FOREIGN PATENT DOCUMENTS 2450631 5/1980 Fed. Rep. of Germany .

*Primary Examiner*—Lowell A. Larson
*Attorney, Agent, or Firm*—Horst M. Kasper

[57] ABSTRACT

An ejector mechanism for multi-stage presses is disclosed. The pusher pin (3) runs inside of a slide (2). The pusher pin is supporter by a lever (6) on a cam curve (7) at the machine frame (1). The cam curve (7) is constructed such that it effects a resting of the pusher pin relative to the machine frame during the period of ejection. The work piece (4) is thereby maintained in an unchanged position between the matrix (34) and the pusher pin (3). The ejection process is interrupted by a lowering of the cam curve (7) by the control means (8). The pusher pin (3) returns to its withdrawn position relative to the slide (2). The pusher pin remains in the withdrawn position for the balance of the backward stroke. An adjustment of the stroke length is performed within the control means (8). A control cam curve (10) is provided, which is composed of several parts (11,12), which can be tilted against each other and which can be slid past each other. The parts thus determine an effective length of the region 13, which is responsible for the timely interruption of the ejection stroke.

22 Claims, 5 Drawing Figures

EJECTOR MECHANISM FOR ECCENTRIC PRESSES

CROSS-REFERENCE TO RELATED APPLICATIONS

This application is a continuation-in-part application of another international application filed under the Patent Cooperation treaty bearing Application Ser. No. PCT/0085/00286 filed Aug. 23, 1985, which in turn is based on the application in the Federal Republic of Germany filed on Oct. 11, 1984 and having the serial number DE No. 3437282 A1, which international application lists the United States as a designated country. The entire disclosure of this latter application, including the drawings thereof, is hereby incorporated in this application as if fully set forth herein.

BACKGROUND OF THE INVENTION

1. Field of the Invention

The present invention relates to an ejector mechanism for eccentric presses including a machine frame and a slide.

2. Brief Description of the Background of the Invention Including Prior Art

A preferred field of application of the present invention includes multi-stage presses for the production of preferably short metallic work pieces such as bolts, screws, shells, bushes and the like.

The invention is primarily concerned with a die side ejector pin, which has to eject a work piece during the return stroke of the slide. Rigorous requirements are applied to the ejection process. The ejected work piece has to be maintained in an unchanged position within the matrix, e.g., at a foremost position within the slide. The transporting device can grip the work piece only if the slide has been withdrawn. During the time period between the front slack point of the slide and the gripping of the raw pieces by the transport mechanism, the raw pieces have to be maintained in an unchanged position by an ejector on the piston side in order to ensure an error free positioning of the molded blank work pieces ahead of the next matrix.

A multi-stage press is known from British Patent GB-PS No. 1,079,300, which exhibits on the piston side an ejection mechanism with a pusher pin. The pusher pin is actuated by a lever, which is hinged at the slide. Upon a lift of the slide, the free end of the lever, which protrudes from the slide, glides over a curve on the machine frame. There are two regions of the curve that provide for a rest position of the pusher pin relative to the slide and also an intermediate region that effects the actual ejection.

By sliding the curve in the direction of the motion of the slide, not only is the stroke length of the pusher pin changed but also a phase shift of the pusher stroke lift is effected. The same holds for the backward final position, which changes with the adjustment of the stroke. In particular, this ejector mechanism is associated with the disadvantage that a resting of the work piece relative to the machine frame during the ejection process is not possible by sliding or shifting of the curve.

U.S. Pat. No. 3,364,721 to Criblez teaches an arrangement for controlling the movement of an auxiliary element on a crank operated device. The Criblez reference teaches the cooperation of levers and cams but does not refer to the ejection of work pieces.

British Pat. No. 2,141,958 to Stehr teaches an ejector device. The ejector device is operated according to the Figs. by a rotating cam device. However, the drawing does not show that a pusher pin is maintained with a spring and actuated by a lever, where the pusher pin retains a work piece in position.

U.S. Pat. No. 4,250,730 teaches a device for the ejection of a shaped work piece at the male die on a cross-feed press for non-cutting metal shaping. The reference teaches that the cam contour P of the cam disk has an arc K concentric to the rocker shaft and joined to straight section G and a runout section L. The reference teaches that a cam shaft is employed and that a cam is hingedly attached to the cam shaft for positioning a hinge that would push an ejector transfer rod 11. In view of the substantial geometric complexity of such an angled connection between a connecting rod and a cam, adjustment and precision of such device are limited.

British Pat. No. GB 2,023,473 A teaches an improved press. A carriage is mounted on a frame to be reciprocable relative to a die by a crankshaft such that a ram will work a work piece free. A bellcrank pivoted by a cam is employed to slide an ejector rod. The adjustment of a cam according to this reference is fairly complicated.

Swiss Pat. No. 472,962 teaches an ejector provision for mechanical presses with automatic ejection from the table and out of the press. The device as shown in the drawing includes several connecting rods and is rather involved for this kind of procedure. In particular, while a cam is employed in transferring the motion to a second pin, the control and adjustment of the motion according to this reference is fairly complicated, and also the precision is limited.

British Pat. No. 1,210,704 teaches mechanical power transmissions. The transmission of the reference includes a first crank mechanism having a first connecting rod for reciprocating a machine part and a second crank mechanism having a crank radius equal to the crank radius of the first crank mechanism and coupled to the first crank mechanism with its rotation axis arranged parallel with the axis of rotation of the first crank mechanism. The reference shows a fairly complex connection between an ejector mechanism and a cam operating lever.

SUMMARY OF THE INVENTION

1. Purposes of the Invention

It is an object of the present invention to provide an ejector mechanism that ensures a rest position of the work piece relative to the matrix during the ejection phase, i.e., at the initiation of the return stroke of the slide and that simultaneously allows a desired adjustment of the stroke length within a reasonable range.

It is another object of the present invention to provide an ejector mechanism that allows precision adjustment of the stroke length of an ejector pin.

It is a further object of the present invention to provide an ejector mechanism where the position of an ejector pin is controlled by an adjustable cam surface controlling the position of an end of a lever.

These and other objects and advantages of the present invention will become evident from the description which follows.

2. Brief Description of the Invention

The present invention provides an ejector mechanism for an eccentric press. It includes driving means attached to a machine frame and to a slide supported in the machine frame in such a way as to provide a preferably straight line motion of the slide. The slide includes a tool, which has a bore hole, for maintaining a work piece in position. A pusher pin passes through a hole in the slide for engaging the work piece and is positioned to eject the work piece out of the tool. A first end of a lever contacts an end of the pusher pin, and during a motion of the slide the second end of the lever contacts a cam curve supported at the machine frame. An adjustable control means which is attached to the machine frame, positions and controls the cam curve. A drag lever, which can have one end hingedly connected to the machine frame and a second end engaged by the control means, can be provided to support the cam curve.

According to this embodiment, the curve formed at the drag lever represents in its course a rest position of the ejector in the slide relative to the machine frame during the ejection phase. It is tilted away as soon as the proper position of the work piece to be picked up by a gripping mechanism is assured.

The drag lever with its curve is supported at its movable side by the control means. The control means can have different forms and embodiments, as long as these operate quickly and accurately enough and as long as they are suitable for transmitting the forces prevailing.

The control means connected to the adjustment means can be a control cam curve actuated according to the operating cycle of the slide.

A further preferred embodiment of the invention entails that the control cam curve is a curve in addition to the above mentioned cam curve. The control cam curve does not determine the course of the ejection process, but it in particular initiates the termination of the ejection process. This is the moment when the ejection process for the work piece is interrupted. It represents in addition the jolt-free joining of the drag lever and of the lever shortly before the start of the operating stroke.

The stroke length of the ejection pusher is adapted by a change at the control curve to the requirements of the transformation process.

The control cam curve can include two parts and can be rotatably positioned with an axis which can be about perpendicular to a radius of the drag lever, which supports the cam curve, at a surface point on the back of the drag lever, where the radius of the drag lever starts at the hinge axis.

The two parts of the control cam curve can be two equivalent regions with corresponding lift positions, and they can be joined such that the seam locations of the active engagement path of the respective part are in an overlapping region of the two parts where the lift position remains constant for a period of time.

The control cam curve is provided in two parts. The control cam curve has two regions in one of which the stroke position of the ejector relative to the machine frame is not varied and which corresponds to the ejection phase and the other to the remaining cycle time. Between the two regions of unchanged stroke there are provided suitable transitions. The two parts of the control cam curve are formed such that each part carries slightly more than half of one of the recited regions so that part regions overlap. The amount of overlap can be changed, and this in turn changes the length of the ejection stroke.

A rotary control cam curve is preferred, since it is easier to actuate within a machine operating cycle.

The two parts of the control cam curve can have two circular regions, where one circular region can represent a largest radius of the cam and the second can represent a smallest radius of the cam and where the circular regions correspond to a constant position of the cam curve.

The two parts of the control cam curve can be journalled at a joint axis, one of the two parts of the control cam curve can be provided with an elongated slot and the second can be provided with a threaded hole. A bolt can be adapted to pass through the elongated slot and be positioned in the threaded hole to provide for an adjustment provision for the relative positioning of the two parts.

The second end of the lever can comprise a bearing and a wheel supported at the bearing where the wheel can protrude beyond the second end of the lever for an antifrictional engagement of the cam curve.

A helical spring can surround part of the pusher pin within the hole in the slide and can rest with one end against the slide such that the second end of the pusher pin is maintained in engagement with the first end of the lever.

The drive means can be a connecting rod tiltably attached to the slide.

Another aspect of the present invention provides an ejector mechanism comprising a slide supported in a machine frame, where the slide includes a tool for maintaining a work piece in position, a pusher pin to push the work piece out of the tool, which pusher pin is actuated by a lever that is contacted by a cam curve supported at the machine frame. An adjustable control means is provided to position the cam curve. A drag lever can be provided to support the cam curve, where the drag lever can have one end hingely connected to the machine frame and a second end engaged by the adjustment means. The control means connected to the adjustment means can comprise a control cam curve actuated according to the operating cycle of the slide. The control cam curve can include two parts, and it can be rotatably positioned with an axis which is about perpendicular to a radius of the drag lever at a surface point on the back of the drag lever, which radius starts at the hinge axis of the drag lever. The control cam curve preferably has two equivalent regions with corresponding lift positions.

A further aspect of the present invention provides a method for ejecting a work piece with an eccentric press. The method is carried out in the following way. A slide supported in a machine frame is returned in a return stroke. A roller attached to an end of a lever with the lever journalled at the slide is rolled along a cam curve for tilting the lever while the slide moves into a work piece release position. For the time of the ejection process, the forward movement of the ejector pin relative to the slide is exactly compensated by the backward movement of the slide. The work piece is maintained in an unchanged position with a pusher pin and then released by withdrawing the pusher pin by lowering the cam curve and allowing a spring resting against the slide and the pusher pin to release. Another work piece is then loaded for a second cycle, while the ejector pin is constantly in its rearward position up to the forward dead center.

The motion of the slider and of the lowering of the cam curve can be coordinated for a cyclical operation. The lowering of the cam curve can be actuated by employing a control cam curve for controlling the motion of the cam curve.

The object of the present invention is achieved by the features set forth above. The cam curve remains unchanged during the ejection phase, independently of the stroke length, both with respect to its course as well as with respect to its position. The ejection phase is terminated by controlled removal of the curve, that is, the curve is "broken off" at the end. To achieve this, a control means is used. The control means is hinged to the machine frame. A pullback spring in the ejection mechanism places the ejector pin into its rearward position. Preferably, the curve is path controlled transersely to the direction of the stroke motion of the slide, since thereby the path length distance for the path control of the cam curve becomes shorter.

The apparatus according to the present invention is associated with the advantage that the ejector pin is placed back again into its backward position early. A protruding ejector pin during the work phase of the slide stroke can result in a breakage in the case of backward extrusion. Therefore, the pusher pin according to the present invention is always in its rearward position during an advance motion of the slide.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
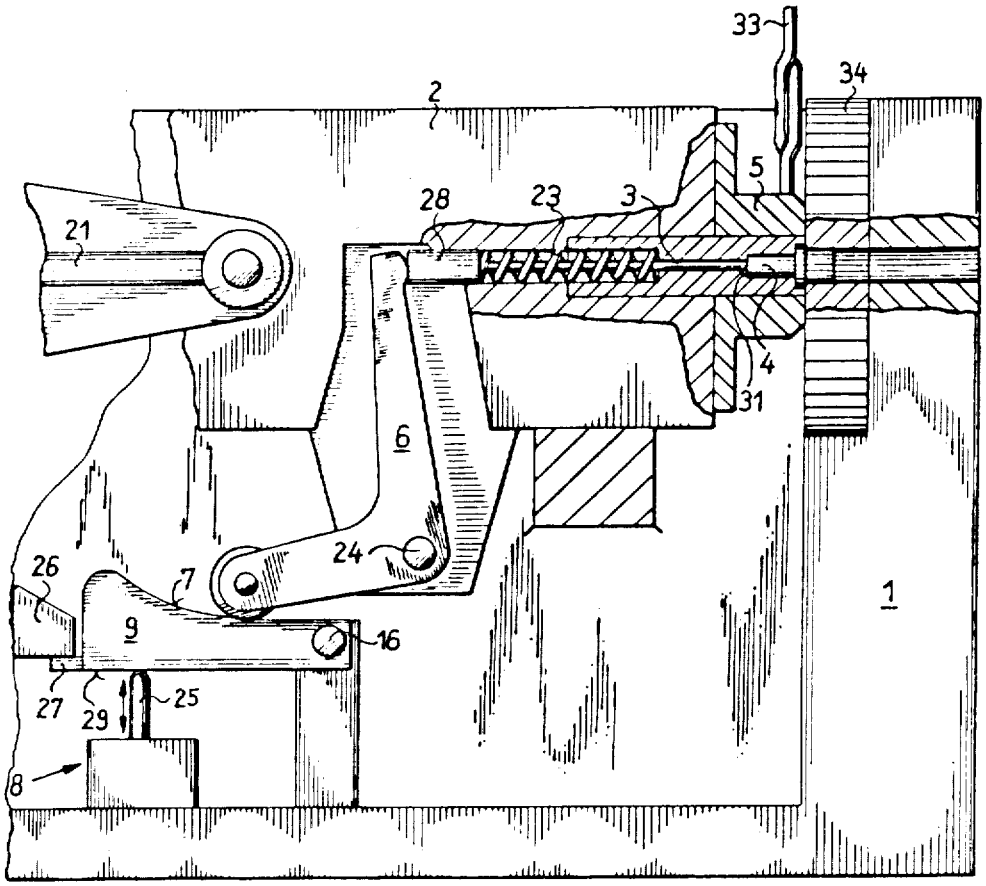
FIG. 1 represents an in part sectional view through a multi-stage press with the representation of the ejector on the die side where a slide is positioned at its forward rest point.

According to the present invention, there is provided an ejector mechanism for eccentric presses with machine frames 1 and slides 2 that include the following features:

(a) A pusher pin 3 that pushes the work piece 4 out of the tool 5.

(b) A lever 6 that actuates the pusher pin 3.

(c) A cam curve 7 disposed at a machine frame 1, over which the lever 6 is passed.

(d) An adjustment means for the cam curve 7.

(e) A control means 8 for the motion actuation of the cam curve 7.

(f) An element carrying the cam curve 7 that is in the form of a drag lever 9 with one end hingedly connected to the machine frame and the other end hingedly connected to the control means 8.

(g) The control means 8 for the cam curve 7 includes a control cam curve 10 actuated according to the operating cycle.

(h) The control curve 10 comprises two parts 11 and 12.

(i) The control cam curve 10 includes two regions 13, 14 with a constant and unchanged lift position for the cam curve 7.

(j) The seam location/overlapping region of the two parts 11, 12 of the control cam curve 10 are disposed within the regions 13, 14 of a constant lift position.

(k) The control cam curve 10 is provided as a rotary control cam curve.

The multi-stage press shown in FIG. 1 has a basic structure as shown in GB-Pat. No. 1079300, as mentioned above and comprises a machine frame 1, a slide 2, supported by a crossbar 39 of the machine frame 1, a tool 5, a taken up work piece 4 with a collar 37 and a stud 38, an ejector pusher pin 3 on the die side, a lever 6 for actuating the ejector pusher pin 3, a connecting rod 21, a cam curve 7 hinged at 16 to a stand 40 of the machine frame, the lever 6 being actuated by the cam curve 7 in connection with the slide movement and a control means 8, which moves the drag lever 9 bearing the cam curve 7.

Figure 2:
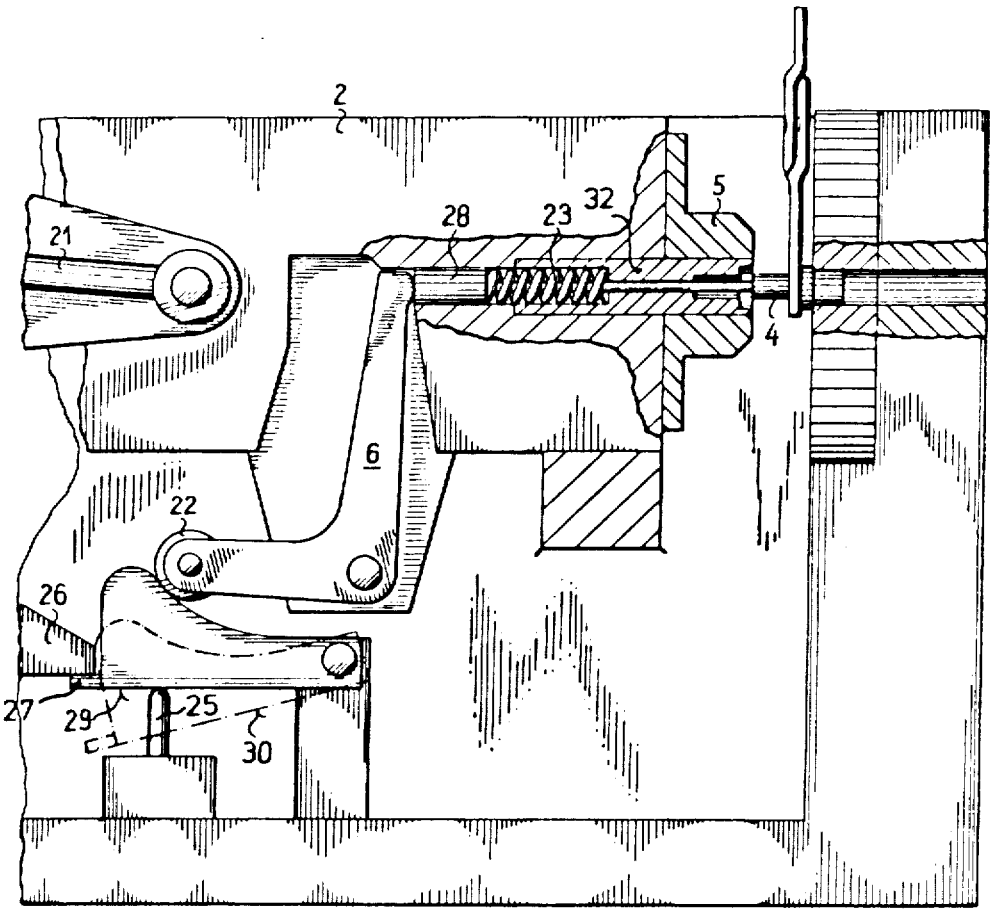
FIG. 2 is a sectional view similar to that of FIG. 1, however where the slide and the ejector are shown at the end of an ejection stroke.

Several tools 5 are disposed perpendicularly to the plane of the paper of FIGS. 1 and 2. Grippers 33 transport the work pieces between the individual tools 5 of the multi-stage press.

The ejector pin 3 guided in the slide includes a head 28, against which a readjusting spring 23 is rested. The readjusting spring 23 is supported on the opposite side at a bushing 32 attached to the slide. In its position shown in FIG. 1, the ejector pin 3 includes a flush juncture with the floor 31 of the tool 5, secured by an abutment 36 in the slide, supporting the lever 6 in its withdrawn position (see FIGS. 1 and 2). The lever 6 is rotatably disposed with the hinge 24 at the slide 2. The lever 6 rests with one end at the head 28 of the ejection pin 3 and supports itself with the other end protruding out of the slide 2 at the cam curve 7. The drag lever 9 carrying the cam curve 7 is attached at the machine frame 1 with a hinge 16.

The position 29 of the drag lever 9 is constant and not varied during the ejection phase of the work piece 4 out of the tool 5. The drag lever 9 is pressed by the control means 8 with a nose 27 against a stop detent 26 at the machine frame side. The cam curve 7 is constructed such that a resting of the ejector pin 3 relative to the machine frame 1 results. This kind of ejector pin is also designated as a synchronous ejector. During the return stroke of the slide, the ejector pin 3 initially remains in an unchanged position relative to the machine frame 1 such that the work piece 4 to be pressed remains in the matrix 34 until the tool 5 on the piston side has released the work piece 4 (Compare FIG. 2). During this time, the work piece 4 cannot slide between the matrix 34 and the ejector pin 3 and is precisely position-guided by the grippers 33 to the next matrix. The ejector pin 3 has then fulfilled its task and returns back into its position relative to the slide 2 as shown in FIG. 1.

In order to interrupt the ejection process and to bring the ejector pin back into its starting position, the drag lever 9 and with it the cam curve 7 is lowered into the position 30. The lowering of the drag lever 9 with the cam curve 7 is performed by the control means 8, the control pin 25 of which is inserted for this purpose. It is decisive in the context of the present invention that during the ejection phase the predetermined path of the lever and thus of the ejection pusher pin 3 is independent of the length of the desired ejection stroke. The ejection stroke is interrupted only at different points in time that correspond to different stroke length and that are determined by control means 8. The cam curve 7 is not preset for the desired ejection stroke length. It is thereby achieved that always the same piece of the curve 7 effects the ejection process and that the length of the stroke of the ejection pusher pin 3 does not have any influence on the position of the curve relative to the machine frame.

The course of the curve 7 is not a straight line, it corresponds much more in its geometry to the requirements of the recited standing still of the ejection pusher pin 3 relative to the machine frame 2, and it takes into consideration the tilting motion of the lever 6. The cam curve 7 can correspond approximately to a trigonometric function such as sine or cosine. Alternate cam curve approximations include about elliptical or hyperbolic shapes.

The stroke length of the ejection pin results from the setting of the control means 8. The control means 8 includes a rotating control cam curve 10 that brings the drag lever 9 into the position 29 or, respectively, that required in each case via a roller 18 at the drag lever 9. The control cam curve 10 has a constant radius in the region 13, which maintains the drag lever 9 and the cam curve 7 in the position 29. The curve region 14 comes to rest at the roller 18 by rotation of the control cam curve 10. Thereby, a spring 17 brings the drag lever in a lower position (in the drawings) and the readjusting spring 23 brings the ejection pin 3 into the rearward position correspoonding to the position 30 of the drag lever 9.

Figure 3:
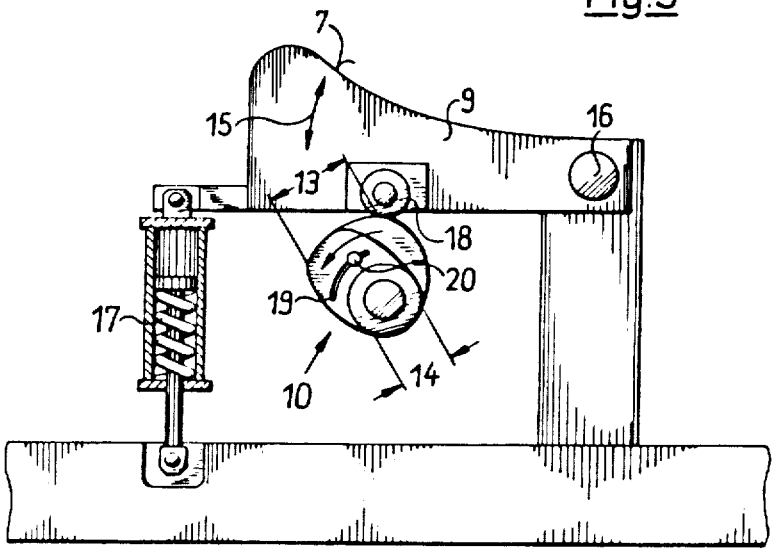
FIG. 3 is a view of a preferred embodiment of the control cam curve device.
Figure 4:
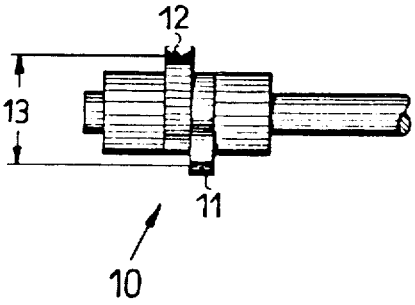
FIG. 4 is a detailed view of a enlarged scale and from a different side of the embodiment shown in FIG. 3.

The effective length of the regions 13 and 14 is changed for adjusting the stroke length of the slide. The control cam curve 10 is formed at least in two parts as illustrated in FIGS. 3 and 4. The parts 11 and 12 of the control cam curve 10 complement each other such that the regions 13 and 14 in each case are formed by a respective section of the control cam curve on the one or the other part recited above. The sections belonging to the region 13 on the two parts 11 and 12 overlap each other in the rotation direction of the control cam curve. The same thing holds for the region 14. The transition from the region 14 to the region 13 is formed on the part 11, and the transition from the region 13 to the region 14 is formed on the part 12. The time during which the region 13 is effective is changed by a change in the amount of overlap. The length of the region 13 is proportional to the stroke length of the ejection pin.

The change of the amount of overlap is performed by a tilting of the parts 11 and 12 against each other on the shaft 35. For this purpose, an elongated hole is provided in the disk 12, through which a screw or bolt 20 passes. The screw or bolt 20 secures the relative position of the parts 11 and 12 with respect to each other.

The recited rest position of the ejection pusher pin 3 is taken into consideration in the cam curve 7, and the transitions between the two positions 29 and 30 are determined by the course of the control cam curve 10.

The mode of operation of the press is as follows:

Starting with the position illustrated in FIG. 1, the slide begins with a return stroke. The ejection pusher pin 3 supported by the lever 6 does not initially follow the path of the slide 2, but remains unchanged, that is, at rest relative to the machine frame 1. Thereby the lever 6 supported at the slide 2 rolls with its roller 22 over the cam curve 7. The stroke motion of the slide is balanced by a tilting motion by the cam curve 7 to the lever. Thereby the complete press reaches the position illustrated in FIG. 2. The ejection pusher pin 3 has maintained the work piece 4 in the position ahead of the matrix 34. It can be recognized that the matrix 34 has an inner core. Now the ejection pusher pin 3 is withdrawn. For this purpose, the cam curve 7 formed at the drag lever 9 is lowered. The lowering is performed by the control cam curve 10, where the roller 18 leaves the region 13 and passes into the region 14, which represents the withdrawn position of the ejection pusher pin. This is at the same time the lowered position 30 of the drag lever 9. The ejection pusher pin 3 remains in this withdrawn position 13 for the balance of the return stroke. The cam curve 7 approaches again jolt-free the roller 22 via the transition from the region 14 into the region 13, whereby the lever 6 is maintained continuously resting at the head 28 of the ejection push pin 3 in a way not shown here.

The lever arm, which engages the second end of the ejection pusher pin is preferably disposed approximately perpendicular to the longitudinal direction of the ejection pusher pin. The lever 6 is preferably constructed as an angled lever with the hinge point at the corner, and the angle is preferably in a range from about 60° to 120° and more preferably in the range from about 85° to 95°. The hinge point of the lever is disposed preferably near a plane which runs perpendicularly about through the second end of the pusher pin. Preferably the arm of the lever contacting the second end of the pusher pin has a length which is from abou 1 to 2 times the length of the second arm of the lever. The first end of the lever arm is provided with a cam for contacting the end face of the ejection pusher pin part 28. The second arm of the lever includes a wheel which is journalled near the end of the second arm of the lever such that the wheel protrudes slightly beyond the end of the second arm of the lever at most points of the wheel with the exception of those points that are relatively close to the hinge 24 of the lever. The axis of the wheel is preferably in parallel to the axis of the lever and perpendicular to the longitudinal direction of the ejector pusher pin. The wheel at the end of the second arm of the lever rests against the cam curve 7. Thus the cam curve 7 should have a length that corresponds at least to the maximum desired length of the ejector stroke taken by the wheel of the second lever arm. The tilting range of the lever can be preferably from about 20° to 50°.

Referring now to FIG. 3, the nose of the cam curve drag lever 9 is preferably connected to the frame via a compression spring, which provides for the drag lever 9 with the cam curve 7 to rest against the control cam curve 10.

Figure 5:
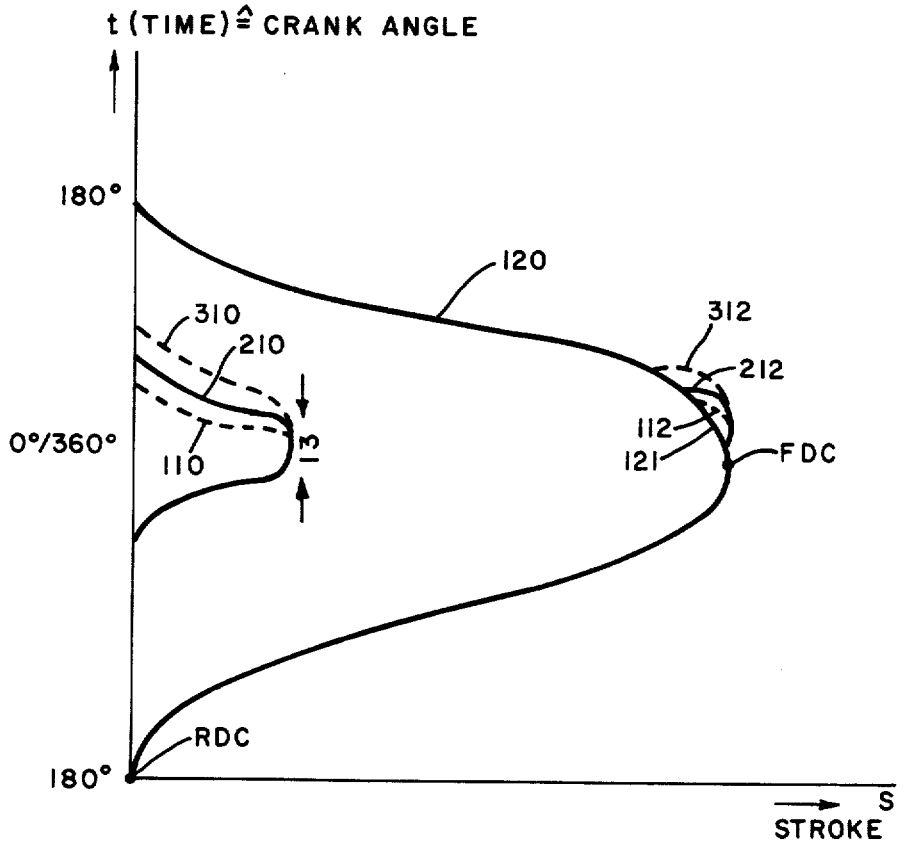
FIG. 5 is a schematic view of a diagram illustrating the distance from the abscissa for the respective stroke and illustrating on the ordinate the angle corresponding to a crank rotation.
Figure 5:
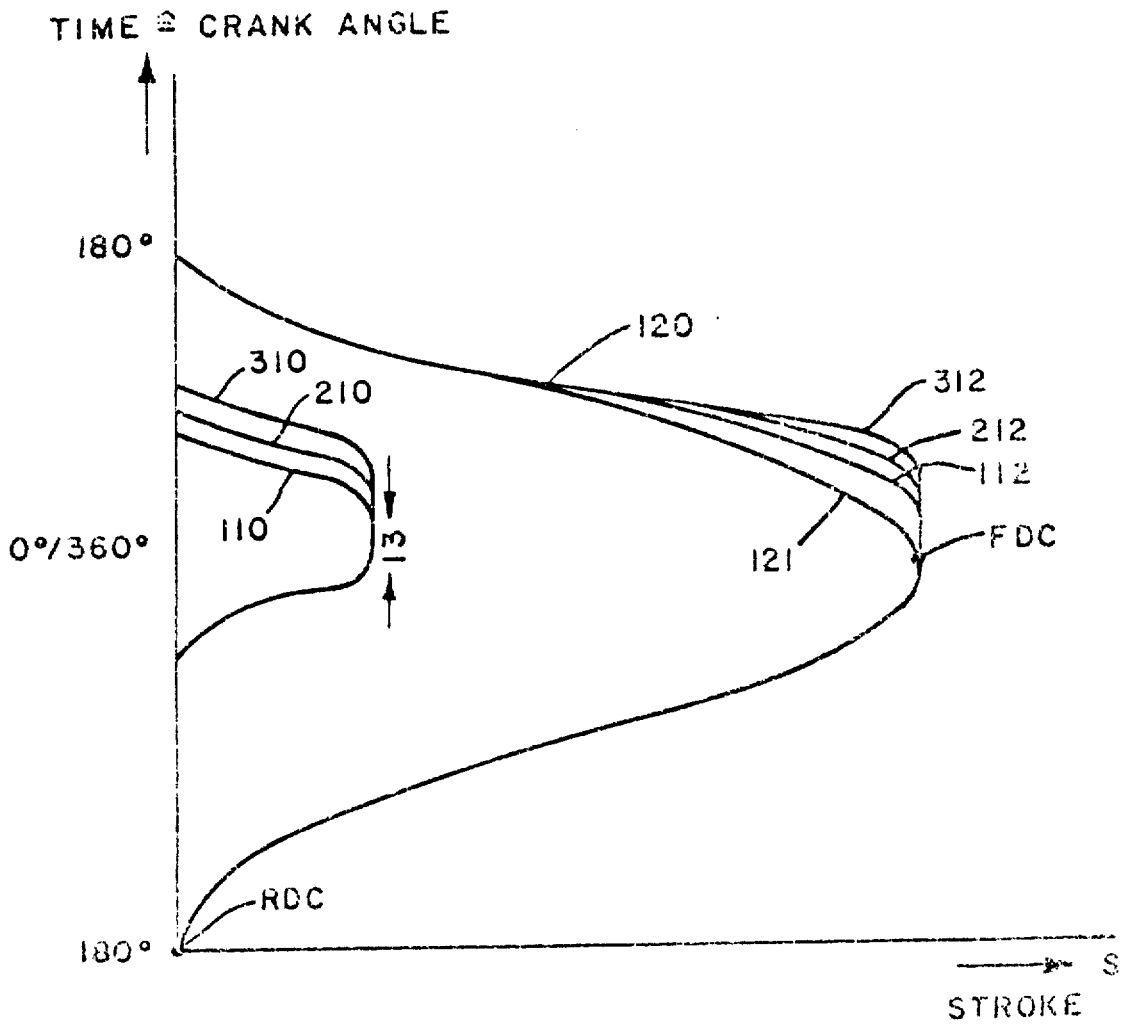

Referring now to FIG. 5, there is shown a distance—angle (time) diagram for the motion involved in the present invention. As can be seen in FIG. 5, there is shown on the abscissa the distance of the stroke and on the ordinate the crank angle, which corresponds to a time scale. The cycle angle corresponds to the angular location of a crank that actuates the machine. The curves 110, 210, 310 show the lift of the drag lever produced by the control cam curve. The dashed line 110 is shown for an adjustment providing for a relatively small time duration of the pusher pin stroke, curve 210 shows one for a more extended time duration of the pusher pin stroke, and curve 310 shows the lift for a long time duration of the pusher pin stroke. The curves 112, 212 and 312 show the relative position of the pusher pin, i.e. the deviation from the movement of the slide. It can be seen that according to the construction of the present invention, various time intervals can be selected for maintaining the pusher pin in a position contacting the work piece. This time duration can be varied by changing the adjustment of the control cam curve with bolt 20.

The curve 120 refers to the motion of the slide 2 and pusher pin 3. The curve 120 will in general follow fairly closely an about sinusoidal curve depending on the mechanism generating the motion. The operation of the control cam curve 10 provides that the ejection pusher pin 3 does not fully follow the sinusoidal curve, but the course of curve 120 shows the joint path of the slide 2 and of the ejector pusher pin 3. The curve 121 shows the path of the slide 2 alone at the point where the action of the control cam curve has displaced the pusher pin 3 relative to the slide 2. The time can be derived on the ordinate based on the plot of the angle of a rotating crank generating the motion. The front dead center point is designated as FDC, and the rear dead center point is designated as RDC. The stroke of the control cam curve 10, which is also shown in FIG. 3, is illustrated with respect to the curve 210.

The pusher pin 3 has to remain in the front position for a crank angle of, for example, 40° starting at the front dead center. This is necessary so that during this time period after the pressing process, the work piece remains in an unchanged position in the matrix such that it can be picked up by the grippers 33 in a defined position.

If the cam curve 7 were to be installed in a fixed position, the pusher pin 3 would remain in the front position over an angle of 360° of the crank, provided, that a corresponding length of the cam curve 7 is available. This would be an impediment to maintaining the work piece in a precise position. Therefore, the cam curve 7 is only then brought into a working position if a forward position of the pusher pin 3 relative to the slide 2 is desired. This front position of the pusher pin is desired according to the invention over an adjustable region that starts with the front dead center point and covers a crank cycle angle from about 20° to 60°, where the angle can be adjusted as desired. The control cam curve 10 carries the cam curve 7 into a working position (Region 13) for the desired crank angle range. Otherwise, that is, substantially over an angle of at least 280° of the crank, the cam curve 7 is in its standard position, which corresponds to the region 14, or the transitions to region 13 and the pusher pin is in a withdrawn position.

It will be understood that each of the elements described above, or two or more together, may also find a useful application in other types of ejection system configurations and procedures differing from the types described above.

While the invention has been illustrated and described as embodied in the context of an ejector mechanism for eccentric presses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ejector mechanism for an eccentric press comprising a machine frame;

driving means attached to the machine frame;

a slide supported in the machine frame and attached to the driving means such as to provide a motion of the slide, where the slide includes a tool for maintaining a work piece in position, said tool having a hole;

a pusher pin passing through a hole in the slide for engaging the work piece, which pusher pin is positioned to eject the work piece out of the tool;

a lever contacting an end of the pusher pin;

a cam curve supported in a fixed position at the machine frame for contacting the lever at times during a motion of the slide and retracable at a selected point during the press operating cycle;

a control means attached to the machine frame for controlling a positioning of the cam curve at said selected point.

2. The ejector mechanism for an eccentric press according to claim 1 further comprising a drag lever for supporting the cam curve, said drag lever having one end hingedly connected to the machine frame and having a second end being engaged by the adjustment means.

3. The ejector mechanism for an eccentric press according to claim 1 wherein the control means connected to the adjustment means comprises a control cam curve actuated according to the operating cycle of the slide.

4. The ejector mechanism for an eccentric press according to claim 3 wherein the control cam curve includes two parts.

5. The ejector mechanism for an eccentric press according to claim 4 further comprising a drag lever for supporting the cam curve, said drag lever having one end hingedly connected to the machine frame and having a second end being engaged by the adjustment means; and wherein the control cam curve is rotatably positioned with an axis which is about perpendicular to a radius of the drag lever at a surface point on the back of the drag lever, which radius starts at the hinge axis of the drag lever.

6. The ejector mechanism for an eccentric press according to claim 4 wherein the control cam curve has two equivalent regions with corresponding lift positions.

7. The ejector mechanism for an eccentric press according to claim 4 wherein the two parts are in an overlapping region of the two parts, where the lift position remains constant for a period of time.

8. The ejector mechanism for an eccentric press according to claim 7 wherein the two parts of the control cam curve have two circular regions, where one of the circular regions represents a largest radius of the cam and wherein a second of the circular regions represents a smallest radius of the cam, which circular regions correspond to a constant position of the cam curve.

9. The ejector mechanism for an eccentric press according to claim 4, wherein the two parts of the control cam curve are journalled at a joint axis;

wherein one of the two parts of the control cam curve is provided with an elongated slot and where the second part of the two parts is provided with a threaded hole;

and further comprising a bolt adapted to pass through the elongated slot and to be positioned in the threaded hole such as to provide for an adjustment provision for the relative positioning of the two parts.

10. The ejector mechanism for an eccentric press according to claim 1 wherein the second end of the lever comprises a bearing; and a wheel supported at the bearing where the wheel protrudes beyond the second end of the lever for an antifriction engagement of the cam curve.

11. The ejector mechanism for an eccentric press according to claim 1 further comprising a helical spring surrounding part of the pusher pin within the hole in the slide and resting with one end against the slide, such that the second end of the pusher pin is maintained in engagement with the first end of the lever.

12. The ejector mechanism for an eccentric press according to claim 1 wherein the drive means is a connecting rod tiltably attached to the slide.

13. The ejector mechanism for an eccentric press according to claim 1 wherein the control means attached to the machine frame for controlling a positioning of the cam curve at said selected point initiates a retraction of the cam curve to remove the cam curve away from the second end of the lever and induces a return of the cam curve for contacting the second end of the lever at a different point of a cycle.

14. An ejector mechanism for an eccentric press comprising a machine frame;

a slide supported in the machine frame, where the slide includes a tool for forming a work piece;

a pusher pin, which pushes the work piece out of the tool;

a lever which actuates the pusher pin;

a cam curve supported in a fixed position at the machine frame for contacting the lever at times during a motion of the slide and retractable at a selected point during the press operating cycle;

a control means attached to the machine frame for controlling a positioning of the cam curve at said selected point.

15. The ejector mechanism for an eccentric press according to claim 14 further comprising a drag lever for supporting the cam curve, said drag lever having one end hingedly connected to the machine frame and having a second end being engaged by the adjustment means.

16. The ejector mechanism for an eccentric press according to claim 14 wherein the control means connected to the adjustment means comprises a control cam curve actuated according to the operating cycle of the slide.

17. The ejector mechanism for an eccentric press according to claim 14 wherein the control cam curve includes two parts, wherein the control cam curve is rotatably positioned with an axis which is about perpendicular to a radius of the drag lever at a surface point on the back of the drag lever, which radius starts at the hinge axis of the drag lever.

18. The ejector mechanism for an eccentric press according to claim 17 wherein the control cam curve has two equivalent regions with corresponding lift positions.

19. The ejector mechanism for an eccentric press according to claim 14 wherein the control means attached to the machine frame for controlling a positioning of the cam curve at said selected point initiates a retraction of the cam curve to remove the cam curve away from the second end of the lever and induces a return of the cam curve for contacting the second end of the lever at a different point of a cycle.

20. A method for ejecting a work piece with an eccentric press comprising returning a slide supported in a machine frame with a return stroke;

rolling a roller attached to and end of a lever with the lever journalled at the slide along a cam curve in a fixed position at the machine frame for tilting the lever while the slide moves into a work piece release position;

maintaining the work piece in a position inside a matrix with a pusher pin in the slide for a crank angle of less than 60°;

withdrawing the pusher pin which had maintained the work piece in position by lowering the cam curve and by allowing a spring resting against the slide and the pusher pin to release for withdrawing the pusher pin from the work piece; and loading another work piece for a second cycle.

21. The method for ejecting a work piece with an eccentric press according to claim 20 further comprising coordinating the motion of the slide and of the lowering of the cam curve for a cyclical operation.

22. The method for ejecting a work piece with an eccentric press according to claim 20 further comprising actuating the lowering of the cam curve by employing a control cam curve for controlling the periods of rest of the cam.

* * * * *

UNITED STATES PATENT AND TRADEMARK OFFICE

CERTIFICATE OF CORRECTION

PATENT NO. : 4,720,990

DATED : January 26, 1988

INVENTOR(S) : Alois Weller

It is certified that error appears in the above-identified patent and that said Letters Patent is hereby corrected as shown below:

The sheet of drawing containing Fig. 5 should be deleted to be replaced with Fig. 5 as shown on the attached steet.

Signed and Sealed this

Seventh Day of June, 1988

*Attest:*

*Attesting Officer*

DONALD J. QUIGG

*Commissioner of Patents and Trademarks*